US010274289B1

(12) United States Patent
Barnhart, II

(10) Patent No.: US 10,274,289 B1
(45) Date of Patent: Apr. 30, 2019

(54) BODY ARMOR VENTILATION SYSTEM

(71) Applicant: Billy James Barnhart, II, Broken Arrow, OK (US)

(72) Inventor: Billy James Barnhart, II, Broken Arrow, OK (US)

( * ) Notice: Subject to any disclaimer, the term of this patent is extended or adjusted under 35 U.S.C. 154(b) by 0 days.

(21) Appl. No.: 15/200,570

(22) Filed: Jul. 1, 2016

(51) Int. Cl.
*F41H 1/02* (2006.01)

(52) U.S. Cl.
CPC ..... *F41H 1/02* (2013.01)

(58) Field of Classification Search
CPC ..... F41H 1/02; F41H 1/00; F41H 5/00; F41H 5/013; F41H 5/02; F41H 5/023; F41H 5/026; F41H 5/04; F41H 5/0414; F41H 5/0428; F41H 5/0435
USPC ..... 89/36.02, 36.01, 36.05; 2/2.5
See application file for complete search history.

(56) References Cited

U.S. PATENT DOCUMENTS 5,030,501 A * 7/1991 Colvin ..... B65D 65/406 428/178
5,444,959 A * 8/1995 Tesch ..... B29D 24/00 52/794.1
5,515,543 A 5/1996 Gioello
5,564,124 A 10/1996 Elsherif et al.
5,970,513 A * 10/1999 Kocher ..... F41H 1/02 2/103
6,609,452 B1 * 8/2003 McCormick ..... C04B 35/563 428/367
6,892,392 B2 * 5/2005 Crye ..... A41D 27/28 2/2.5
7,636,955 B2 12/2009 Plut
7,685,922 B1 * 3/2010 Martin ..... F41H 5/0414 89/36.01
7,827,624 B1 11/2010 Cole
7,926,124 B2 * 4/2011 Hunter ..... A45F 3/04 2/2.5
8,156,570 B1 4/2012 Hockaday
8,756,718 B2 6/2014 Tymofy
8,819,984 B2 * 9/2014 Borkowski ..... F41C 23/02 2/2.5
8,904,915 B2 12/2014 Howland
9,459,079 B1 * 10/2016 Dudt ..... F41H 5/0457
2003/0150321 A1 * 8/2003 Lucuta ..... F41H 5/0414 89/36.02
2004/0216595 A1 * 11/2004 Dickson ..... F41H 5/0464 89/36.02
2005/0246826 A1 11/2005 McCarter et al.
2007/0000001 A1 * 1/2007 Tomann ..... A41D 13/002 2/2.5

(Continued)

FOREIGN PATENT DOCUMENTS

EP 2878914 A1 * 6/2015 ..... F41H 1/02
EP EP 2878914 A1 * 6/2015 ..... F41H 1/02

*Primary Examiner* — John Cooper
(74) *Attorney, Agent, or Firm* — Head, Johnson, Kachigian & Wilkinson, PC

(57) ABSTRACT

A body armor ventilation system comprising a plurality of projections located between a body armor carrier and a wearer's body. The system may further comprise a plate for retrofitting an existing carrier or may be integrated into the carrier. The projections may allow space between the body armor carrier and the wearer's body, allowing air to flow therethrough, which in turn allows the wearer's body heat to dissipate and keeps the wearer cooler. The projections may also provide increased protection from blunt force trauma.

12 Claims, 5 Drawing Sheets

(56) References Cited

U.S. PATENT DOCUMENTS

2007/0118956 A1* 5/2007 Sawicki ..... A41D 13/0025
2/69
2008/0236378 A1* 10/2008 Sane ..... F41H 5/0428
89/36.02
2009/0100578 A1* 4/2009 Coates ..... A41D 13/05
2/455
2009/0282595 A1* 11/2009 Branson ..... F41H 1/02
2/2.5
2010/0319381 A1* 12/2010 Hubler ..... A41D 13/0053
62/259.3
2010/0325773 A1* 12/2010 Rock ..... A41D 1/04
2/113
2011/0113951 A1* 5/2011 Daley ..... F41H 5/04
89/36.02
2011/0231985 A1* 9/2011 Bishop ..... A41D 13/05
2/456
2012/0132066 A1* 5/2012 Seuk ..... F41H 1/02
89/36.05
2012/0174748 A1* 7/2012 Landi ..... F41H 1/02
89/36.02
2012/0246788 A1* 10/2012 Harrell ..... A41D 31/005
2/2.5
2013/0097759 A1* 4/2013 Strum ..... F41H 1/02
2/2.5
2014/0069617 A1* 3/2014 Shelton ..... F41H 1/02
165/120
2016/0029713 A1* 2/2016 Bishop ..... A41D 13/05
2/2.5
2016/0238347 A1* 8/2016 Blauer ..... F41H 1/02

* cited by examiner

BODY ARMOR VENTILATION SYSTEM

CROSS REFERENCE

Not Applicable.

BACKGROUND OF THE INVENTION

Field of the Invention

This invention relates generally to a ventilation system for body armor and more particularly, but not by way of limitation, to a system of raised projections to lift body armor off of a wearer's body to allow the introduction of air therebetween.

Description of the Related Art

Body armor can save the lives of military personnel and law enforcement officers, but only if it is properly worn. One of the primary reasons why an individual might not properly wear their body armor is heat: body armor does not breath, and even in cool temperatures, the wearer's body heat can build up underneath the body armor to uncomfortable levels. When worn in warm temperatures, the wearer's body temperature can rise to intolerable levels. Thus, particularly in hot climates, wearing body armor can lead to injury, illness, and even death.

Generally, there is inadequate air flow between the vest and the wearer's body, creating significant heat retention and increasing the core body temperature, resulting in heat casualties. Body armor is typically designated for use either underneath or over the wearer's clothes or uniform. The typical body armor and carrier is not specifically designed for air flow, but a low profile while providing protection to the wearer. This design configuration has led others to develop costly products or advanced materials that tend to constrict, limit, or complicate the wearer's ability to respond and perform their duties by limiting use to a vehicle, requiring batteries to be changed, adding maintenance such as changing fluids, or adding weight, such as with fans. These products complicate the user's life instead of helping. These products either do not solve the basic problem, namely air flow, or are too expensive or complicated for the user. The high costs and limitations of current devices lead many individuals to simply not wear their life-saving body armor when it is hot outside.

In short, there are a limited number of products on the market aimed at addressing this issue, but none are practical without limiting the wearer's abilities, interfering with duties, requiring increased maintenance, being cumbersome, or requiring the purchase of costly attachments.

Based on the foregoing, it is desirable to provide a body armor ventilation system that improves the natural air flow between the wearer and their body armor.

It is further desirable for the system to be simple and cost effective.

It is further desirable for the system to require no moving parts to require maintenance or to break.

It is further desirable for the system to be suitable for production and/or use by any body armor manufacturer on any of their body armor products or for retrofitting by the wearer of any existing body armor products.

SUMMARY OF THE INVENTION

The invention relates to a body armor ventilation system comprising a plurality of projections and a plurality of interconnecting spaces between the projections. The projections may be oriented in a grid, a circle, or another pattern. The system may further comprise a vertical central channel, where the vertical central channel is free of projections, and/or a horizontal central channel, where the horizontal central channel is free of projections.

Each of the projections may be generally cylindrical such that each has an axis, the plurality of projections lie in a plane, and the axis of each projection is perpendicular to the plane in which the projections lie. Alternately, the projections may be elongate and either solid or tubular and may run parallel to the body armor carrier. The projections may be made of flexible material and may incorporate cooling material, such as cooling gel.

The system may further comprise a plate with a front and a back, where the plurality of projections project outwardly from the front of the plate. The plate may be at least partially flexible. The system may further comprise a second plate with a front and a back, where the second plate likewise comprises a plurality of projections, where the plurality of projections project outwardly from the front of the second plate, and a plurality of interconnecting spaces between the projections. The plate may be receivable in a body armor carrier. The system may further comprise at least one attachment device capable of attaching the plate to the body armor carrier, such as hook and loop material. The at least one attachment device may be located on the back of the plate.

The plate may have: a bottom side; a right side, where the right side is generally perpendicular to the bottom side; a left side, where the left side is generally perpendicular to the bottom side and generally parallel to the right side; a top side, where the top side is generally parallel to the bottom side and shorter than the bottom side; a right angled side connecting the right side to the top side; and a left angled side connecting the left side to the top side, where the right angled side and the left angled side angle in opposite directions at generally the same degree of incline.

Alternately, the system may further comprise a body armor carrier, where the body armor carrier comprises a chest portion and a back portion. The chest portion and the back portion may each have a front and a back, where the back is capable of being worn adjacent a wearer. The plurality of projections may project outwardly from the backs of the chest portion and the back portion such that the projections are located between the carrier and the wearer during use.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a simple system for individuals that wear body armor to reduce heat retention, reducing fatigue associated with heat retention, and improving air flow to the body to facilitate improved cool-down. The system may be incorporated with the carrier of any manufacturer of body armor or may be used with current technologies and products on the market. The system may maximize the benefits of natural and man-made air, wind, or breeze to achieve desired results.

Figure 8:
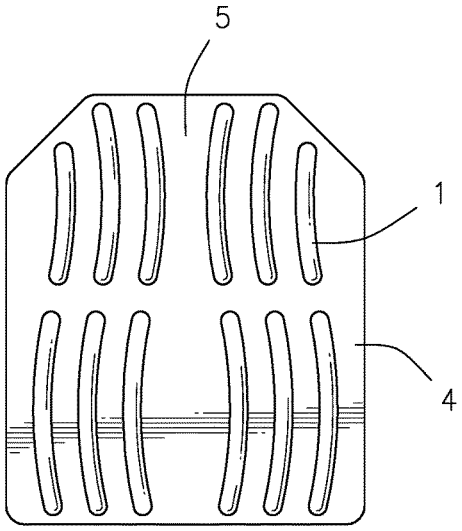
Figure 9:
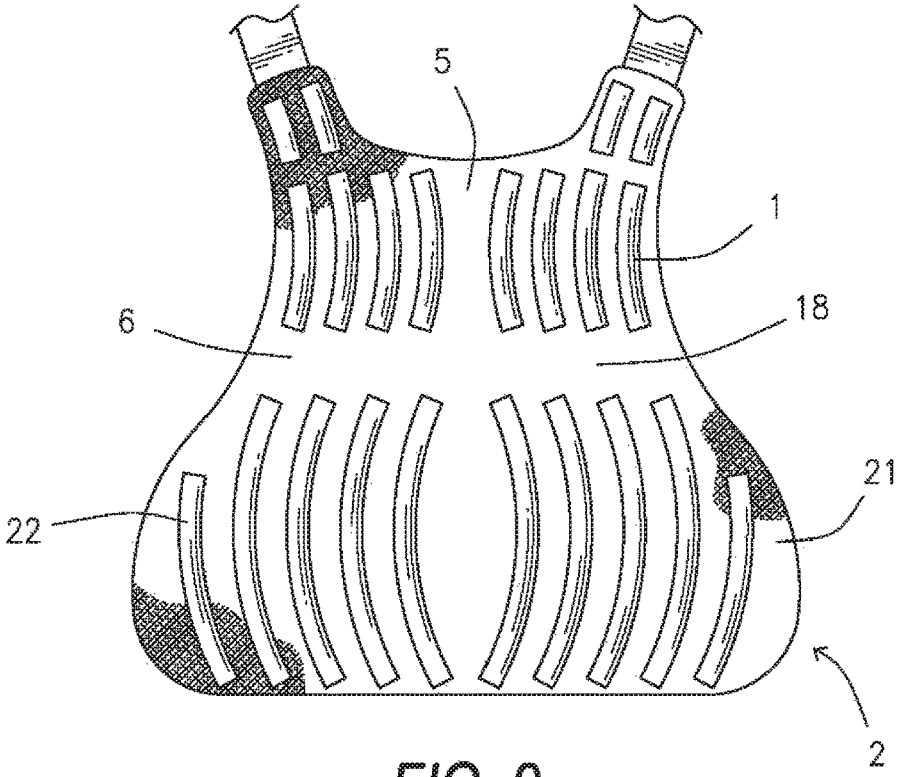
FIG. 9 is a front view of the integrated version of the body armor ventilation system.
Figure 10:
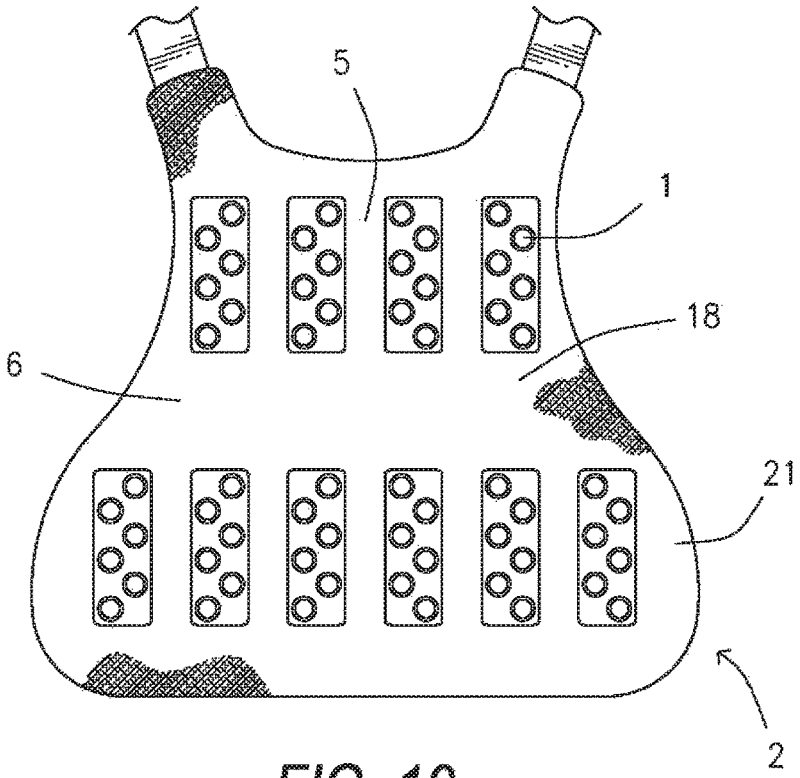
FIG. 10 is a front view of an alternate version of the integrated version of the body armor ventilation system.

The system may comprise a plurality of projections 1 located between a body armor carrier 2 and a wearer's body 3. The system may further comprise a plate 4, as shown in FIGS. 1 through 8, for retrofitting an existing carrier 2 or may be integrated into the carrier 2, as shown in FIGS. 9 and 10. The projections 1 may allow space between the body armor carrier 2 and the wearer's body 3, allowing air to flow therethrough, which in turn allows the wearer's body heat to dissipate and keeps the wearer cooler. The projections 1 may also provide increased protection from blunt force trauma.

Figure 1:
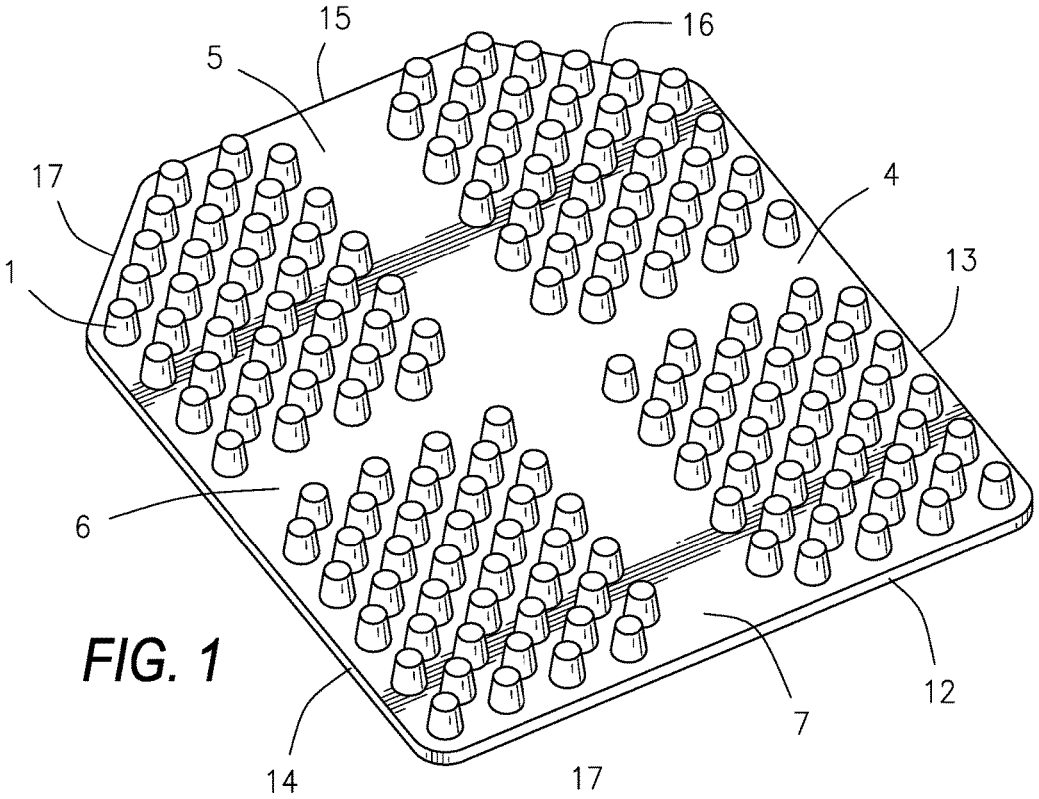
FIG. 1 is a perspective view of the front of the plate version of the body armor ventilation system.
Figure 5:
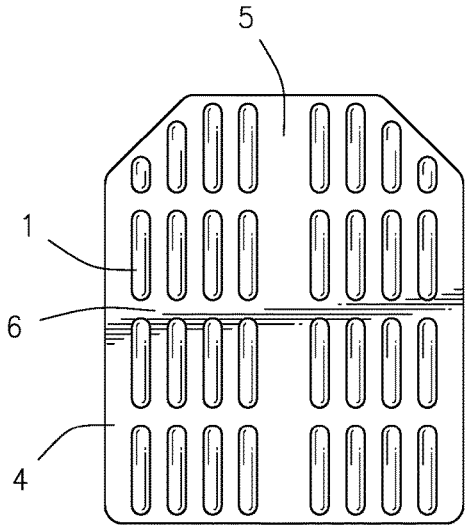
FIGS. 5, 6, 7, and 8 are alternate versions of the plate version of the body armor ventilation system.
Figure 7:
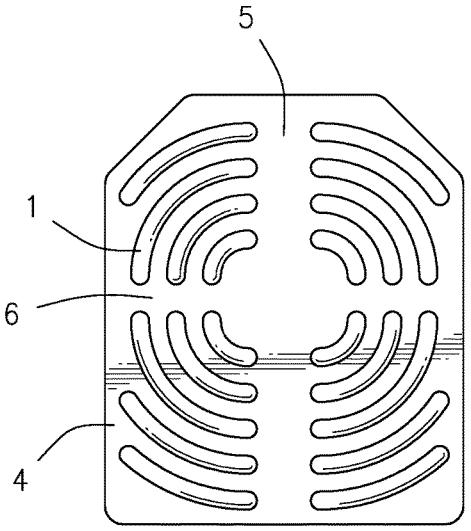

The projections 1 may be oriented in a grid, for example as shown in FIGS. 1 and 5, or in a circular pattern, for example as shown in FIG. 7. Each projection 1 may be spaced from all other projections 1 such that air may flow between the projections 1. For example, each projection 1 may be spaced 1 to 2 inches from any other projection, or any desired distance. The projections 1 may be arranged such that they form a vertical central channel 5. The vertical central channel 5 may be centered on the plate 4 or carrier 2 such that it is located at the midline of the wearer's body 3 during use. Because heat rises, the vertical orientation of the vertical central channel 5 may allow an unencumbered path for airflow at the wearer's core, as indicated by arrows in FIG. 4, maximizing cooling. The projections 1 may also be arranged such that they form a horizontal central channel 6. The horizontal central channel 6 may maximize lateral air flow between the carrier 2 and the wearer's body 3, also as indicated by arrows in FIG. 4. This may be particularly useful when the wearer is in a location with lateral air flow, such as outdoors on a breezy day or in front of a fan. The wearer may orient him or herself such that the laterally flowing air enters the horizontal central channel 6 and travels therethrough between the carrier 2 and the wearer's body 3. Either or both of the vertical central channel 5 and/or the horizontal central channel 6 may be larger than the average space between projections 1 as a whole. The vertical central channel 5 and/or the horizontal central channel 6 may be unencumbered by projections 1 or other structures.

Figure 6:
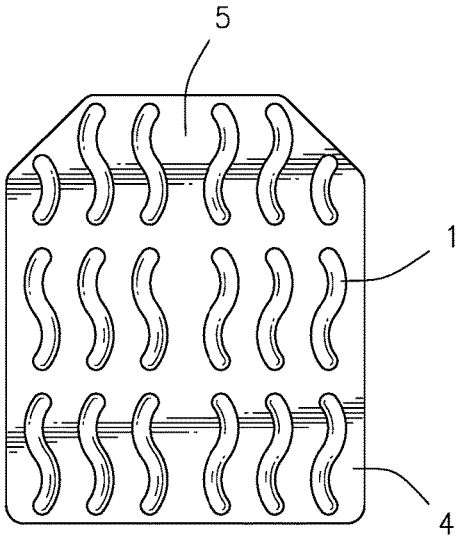

The projections 1 may be nubs, as shown in FIGS. 1 through 4 and 10. The nubs may be generally cylindrical, such that the nubs may have a generally circular cross section, as shown. Alternately, the nubs may have any other desired cross section. The nubs may have a blunt tip, as shown, for comfort, as the blunt tip may provide a larger surface area for the weight of the body armor to rest against the body than a rounded or pointed tip. Alternately, the nubs may have a rounded tip, a pointed tip, or any other shaped tip desired. Alternately, the projections 1 may be ribs, as shown in FIGS. 5 through 8 and 9. The ribs may be elongate and attach to the plate 4 or carrier 2 along their sides. The ribs may have a circular cross section, a rectangular cross section, or any other shaped cross section desired. The ribs may be solid for added structure or may be hollow, as in tubing, for comfort and compressibility, perforated, or a combination thereof. The ribs may be arranged in straight lines, as shown in FIG. 5; in wavy lines, as shown in FIG. 6; in curved lines, as shown in FIGS. 8 and 9; or in any other arrangement desired.

Figure 2:
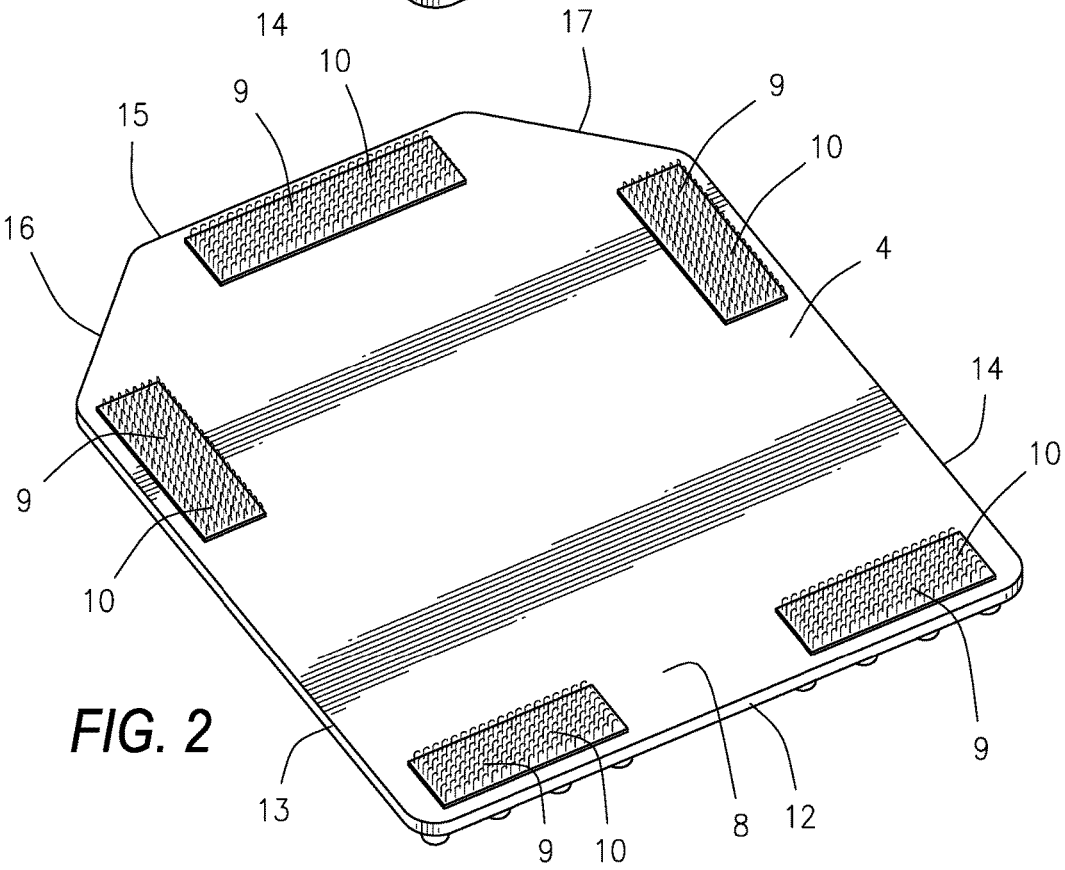
FIG. 2 is a perspective view of the back of the plate version of the body armor ventilation system.
Figure 3:
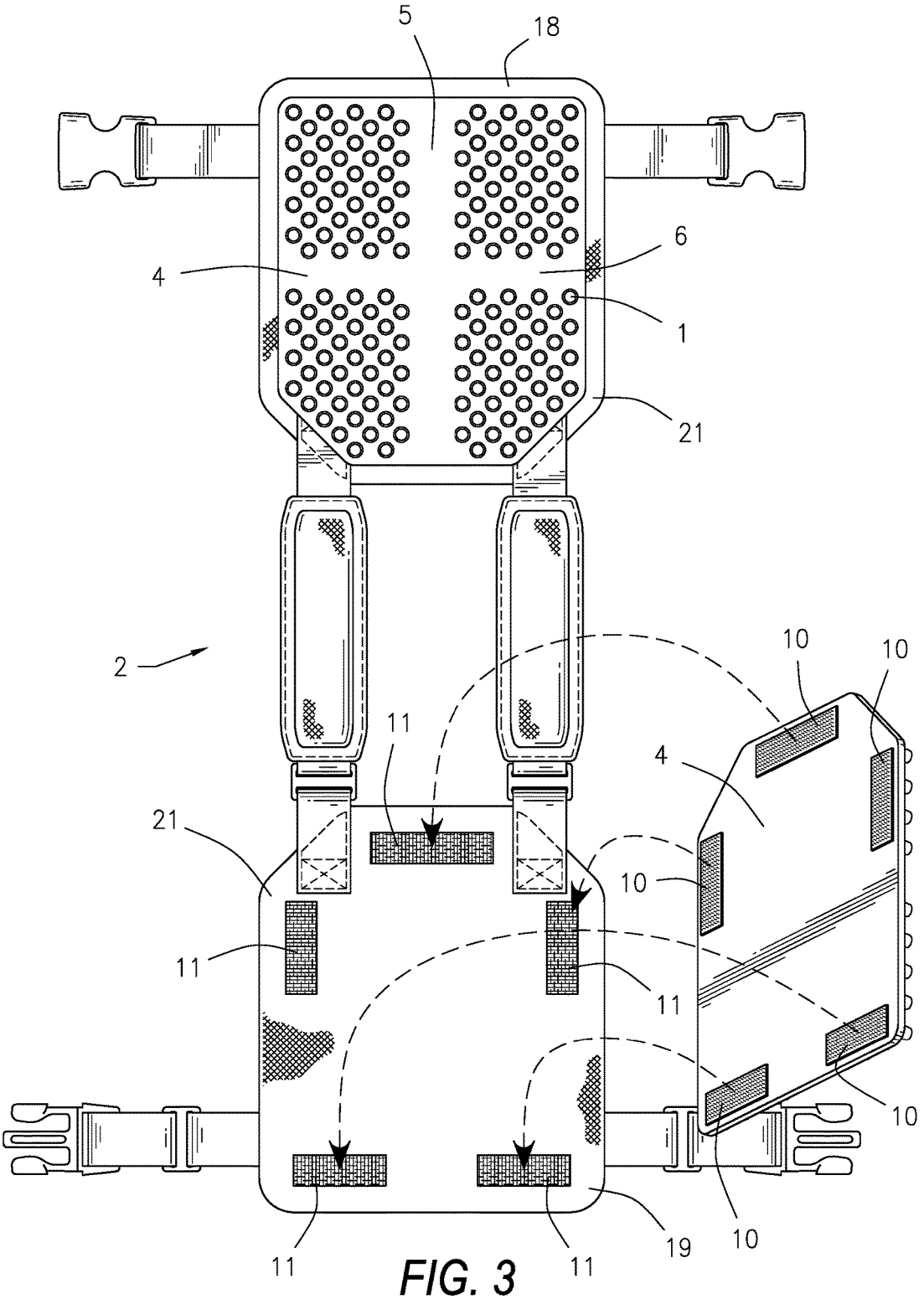
FIG. 3 is a front view of the plate version of the body armor ventilation system being put in place on a protective vest.
Figure 4:
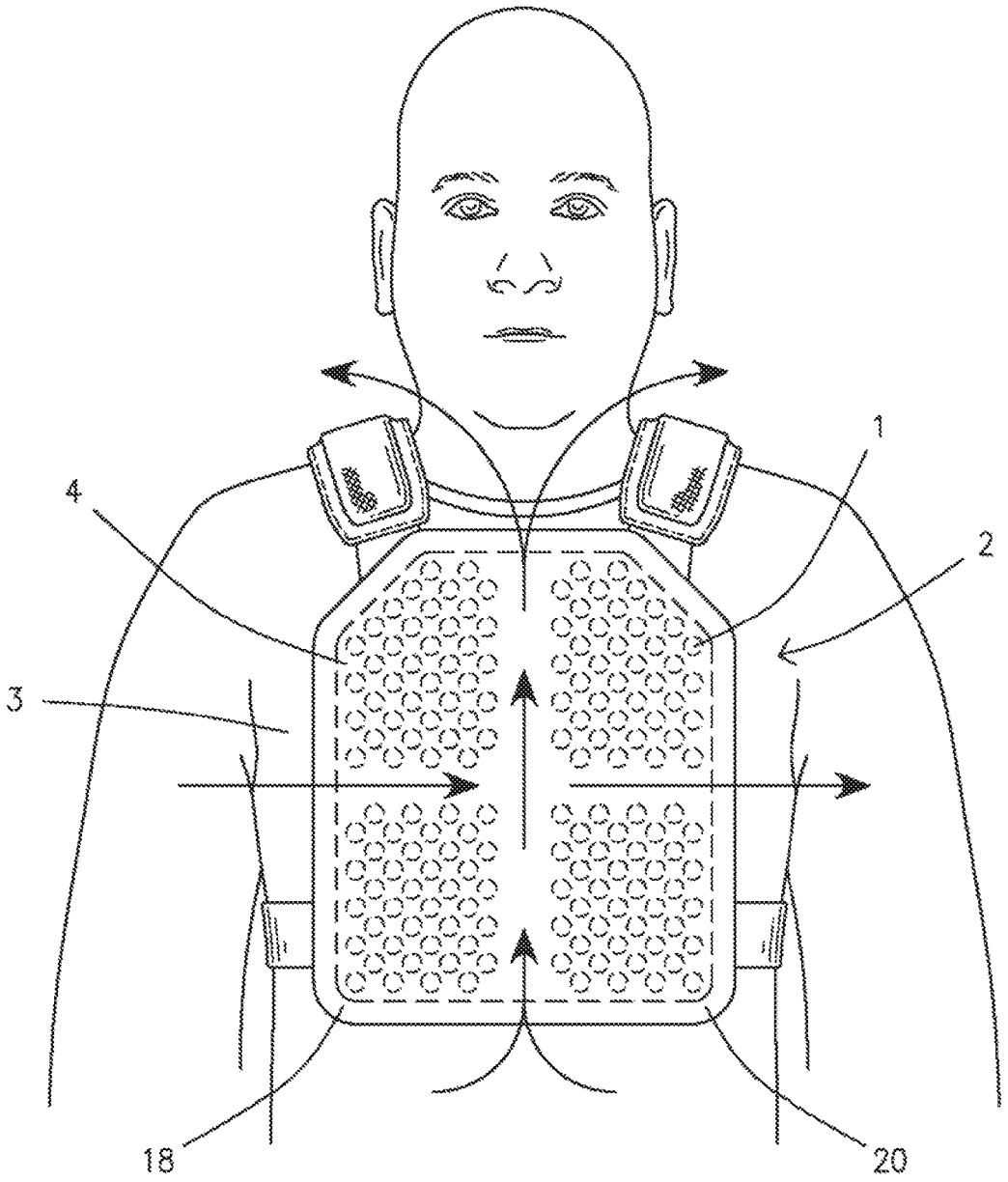
FIG. 4 is a front view of the plate version of the body armor ventilation system in place on a protective vest during wear.

In the plate version of the system, shown in FIGS. 1 through 8, the projections 1 may project outwardly from the front 7 of the plate 4, as shown in FIG. 1. The plate version of the system may comprise two plates 4, as shown in FIG. 3, one for between the carrier 2 and the wearer's chest and one for between the carrier 2 and the wearer's back. Each plate 4 may be at least partially flexible, such that the plate 4 may at least partially conform to the contours of the wearer's body 3.

The back 8 of the plate 4 may have one or more attachment devices 9 for attaching the plate 4 to the carrier 2. For example, as shown in FIGS. 2 and 3, the attachment devices 9 may be hook and loop material. One or more areas 10 of either hook or loop material may be located on the back 8 of the plate 4, and one or more corresponding areas 11 of either loop or hook material, the opposite of areas 10, may be located on the inside face of the carrier 2. Thus, the plate 1 may be mounted to the carrier 2 such that it is located between the carrier 2 and the wearer's body 3, with the projections 1 extending from the plate 4 toward the wearer's body 3. The areas 11 may be manufactured or otherwise attached to the carrier 2 by the manufacturer, or may be later added to the carrier 2 by the user, either through adhesive, sewing, or any other attachment technique. Alternately, the attachment devices 9 may be buttons, hooks, snaps, toggles, magnets, or any other attachment devices desired.

The plate 4 may be shaped to fit within a particular carrier 2 or may have a universal shape such that it may be used in any carrier 2, including external carriers, concealed carriers, or any other styles of carriers in any size. For example, as shown in FIGS. 1 through 8, the plate 4 may have a bottom side 12, a right side 13, and a left side 14, where the right side 13 and left side 14 are generally perpendicular to the bottom side 12. The plate 4 may also have a top side 15, where the top side 15 is generally parallel to the bottom side 12 and shorter than the bottom side 12. The plate 4 may further have a right angled side 16 connecting the right side 13 to the top side 15 and a left angled side 17 connecting the left side 14 to the top side 15. The right angled side 16 and the left angled side 17 may angle in opposite directions at generally the same degree of incline. In other words, the plate 4 may form a hexagon with two right angles. Each of the sides 12, 13, 14, 15, 16, and 17 may be straight or curved, as desired.

In the integrated version of the system, as shown in FIGS. 9 and 10, the projections 1 may be integrated into the carrier 2. For example, the manufacturer may include the projections 1 during manufacture of the carrier 2. The carrier 2 may be an external carrier, a concealed carrier, or any other style of carrier in any size. The carrier 2 may comprise a chest portion 18 and a back portion 19, each of which may have a front 20 and a back 21, where the back 21 is normally adjacent the wearer during use. The projections 1 may project from the back 21 of either or both the chest portion 18 and/or the back portion 19. Thus, the projections 1 may be located between the carrier 2 and the wearer's body 3 during use.

The projections 1, in both the plate and integrated versions, may be made of any desired material. For example, the projections 1 may be made of rubber, foam rubber, foam, plastic, nylon, silicone, cotton, or any other material desired. The projections 1 may incorporate a cooling material, such as a cooling gel. The plate 4 in the plate version may be made any of the foregoing materials, and may be the same material as the projections 1 or a different material. In both versions, the projections 1 may be either uncovered or partially or fully covered by a covering 22, such as cotton fabric or any other material desired.

The system may also be used with other non-breathable items that come into contact with the body, such as backpacks, rucksacks, equipment carriers, lawn care equipment, seats or chairs such as in homes, offices, cars, airplanes, etc., portable stadium seating, shoulder straps, floor mats, garage mats, mechanics mats helmets, hard hats, scuba tanks or vests, various sporting goods equipment, clothing and uniforms, etc.

Whereas, the devices and methods have been described in relation to the drawings and claims, it should be understood that other and further modifications, apart from those shown or suggested herein, may be made within the spirit and scope of this invention.

What is claimed is:

1. A body armor ventilation system comprising:

a body armor carrier, a plate capable of attaching to a body armor carrier, or a body armor carrier and a plate capable of attaching to the body armor carrier;

a plurality of projections, where the plurality of projections project outwardly from the body armor carrier or the plate and where each of the plurality of projections is separated a distance of no more than two inches from any neighboring projection;

a plurality of interconnecting spaces between the projections; and a vertical central channel, a horizontal central channel, or both a vertical central channel and a horizontal central channel, where:

the vertical central channel is free of projections, where projections on either side of the vertical central channel are not considered neighboring projections for spacing purposes and where the vertical central channel is wider than the distance between neighboring projections; and the horizontal central channel is free of projections, where projections on either side of the horizontal central channel are not considered neighboring projections for spacing purposes and where the horizontal central channel is taller than the distance between neighboring projections:

such that the body armor carrier or the plate from which the plurality of projections outwardly projects has a surface area and the plurality of projections covers approximately ⅓ of the surface area; and where the projections allow the body armor carrier or the plate to be spaced from a user's body during use such that air flows through the plurality of interconnecting spaces between the user's body and the body armor carrier or the plate, from one space to the next.

2. The system of claim 1 where the projections are oriented in a grid.

3. The system of claim 1 where each of the projections is cylindrical such that each has an axis, the plurality of projections lie in a plane, and the axis of each projection is perpendicular to the plane in which the projections lie.

4. The system of claim 1 where the body armor carrier, plate capable of attaching to a body armor carrier, or body armor carrier and plate capable of attaching to the body armor carrier is a body armor carrier, where:

the body armor carrier comprises a chest portion and a back portion;

the chest portion and the back portion each have a front and a back, where the back is capable of being worn adjacent a wearer; and the plurality of projections project outwardly from the backs of the chest portion and the back portion such that the projections are located between the carrier and the wearer during use.

5. A body armor ventilation system comprising:

a plate capable of attaching to a body armor carrier, where the plate has a front and a back;

a plurality of projections, where the plurality of projections project outwardly from the front of the plate and where each of the plurality of projections is separated a distance of no more than two inches from any neighboring projection:

a plurality of interconnecting spaces between the projections; and a vertical central channel, a horizontal central channel, or both a vertical central channel and a horizontal central channel, where:

the vertical central channel is free of projections, where projections on either side of the vertical central channel are not considered neighboring projections for spacing purposes and where the vertical central channel is wider than the distance between neighboring projections; and the horizontal central channel is free of projections, where projections on either side of the horizontal central channel are not considered neighboring projections for spacing purposes and where the horizontal central channel is taller than the distance between neighboring projections;

such that the plate has a surface area and the plurality of projections covers approximately ⅓ of the surface area; and where the projections allow the plate to be spaced from a user's body during use such that air flows through the plurality of interconnecting spaces between the user's body and the plate, from one space to the next.

6. The system of claim 5 the plate is flexible such that the plate is capable of at least partially conforming to the user's body.

7. The system of claim 5 further comprising a second plate with a front and a back, where the second plate comprises:

a plurality of projections, where the plurality of projections project outwardly from the front of the second plate; and a plurality of interconnecting spaces between the projections.

8. The system of claim 5 the plate is receivable in a body armor carrier.

9. The system of claim 8 further comprising at least one attachment device capable of attaching the plate to the body armor carrier.

10. The system of claim 9 the at least one attachment device is hook and loop material.

11. The system of claim 9 where the at least one attachment device is located on the back of the plate.

12. The system of claim 5 the plate has:

a bottom side;

a right side, where the right side is perpendicular to the bottom side;

a left side, where the left side is perpendicular to the bottom side and parallel to the right side;

a top side, where the top side is parallel to the bottom side and shorter than the bottom side;

a right angled side connecting the right side to the top side; and a left angled side connecting the left side to the top side, where the right angled side and the left angled side angle in opposite directions at generally the same degree of incline.

* * * * *